US005578371A

United States Patent [19]

Taylor et al.

[11] Patent Number: 5,578,371

[45] Date of Patent: Nov. 26, 1996

[54] PHENOL/FORMALDEHYDE FIBERGLASS BINDER COMPOSITIONS EXHIBITING REDUCED EMISSIONS

[75] Inventors: Thomas J. Taylor, Englewood; Ronald D. Shannon, Morrison, both of Colo.

[73] Assignee: Schuller International, Inc., Denver, Colo.

[21] Appl. No.: 519,376

[22] Filed: Aug. 25, 1995

[51] Int. Cl.[6] ..... D04H 1/58

[52] U.S. Cl. ..... 428/288; 427/389.8; 524/841; 525/390; 525/398

[58] Field of Search ..... 524/841; 525/340, 525/398; 427/389.8; 428/288

[56] References Cited

U.S. PATENT DOCUMENTS

| | | | |
|---|---|---|---|
| 3,108,990 | 10/1963 | Baxter | 260/45.7 |
| 4,101,498 | 7/1978 | Snyder | 260/42.45 |
| 4,409,375 | 10/1983 | Hartman et al. | 525/505 |
| 4,458,049 | 7/1984 | Diem et al. | 524/595 |
| 4,757,108 | 7/1988 | Walisser | 524/596 |
| 5,108,798 | 4/1992 | Guerro et al. | 427/389.8 |
| 5,318,990 | 6/1994 | Strauss | 524/549 |
| 5,340,868 | 8/1994 | Strauss | 524/461 |

OTHER PUBLICATIONS

"Fiberglass" J. Gilbert Mohr and William Rowe Van Nostrand Reinhold Co, New York 1978.

Phenolic Resins, A. Knop, et al., Springer–Verlag New York, C 1985, pp. 214–219.

*Primary Examiner*—James J. Bell

*Attorney, Agent, or Firm*—Cornelius P. Quinn

[57] ABSTRACT

Fiberglass binder solutions based on phenol/formaldehyde resins emit lower formaldehyde emissions when a water soluble bisulfite formaldehyde scavenger is added to the binder prior to spraying onto fiberglass. Sodium bisulfite and ammonium bisulfite in amounts of from 4 to 6 percent based on binder solids can reduce formaldehyde emissions by c.a. 50 percent. The fiberglass products prepared from the binders exhibit no significant loss of physical properties as compared to conventional binders.

20 Claims, No Drawings

PHENOL/FORMALDEHYDE FIBERGLASS BINDER COMPOSITIONS EXHIBITING REDUCED EMISSIONS

TECHNICAL FIELD

The present invention pertains to binder-coated fiberglass. More particularly, the present invention pertains to phenol/formaldehyde compositions to which bisulfite is added prior to application of the binder solution to newly formed glass fibers. The binder compositions emit less formaldehyde during both the forming and curing stages of fiberglass products, and in addition allow for ammonia reductions during the curing stage.

BACKGROUND ART

Fiberglass comes in many shapes and sizes and can be used for a variety of applications. A general discussion of fiberglass manufacturing and technology is contained in *Fiberglass* by J. Gilbert Mohr and William P. Rowe, Van Nostrand Reinhold Company, New York 1978, which is herein incorporated by reference. During the preparation of fiberglass, whether by a blown fiber or continuous filament manufacturing process, the resulting glass fibers may easily be degraded in their strength characteristics by the self-abrasive motion of one fiber passing over or interacting with another. As a result of this self-abrasion, surface defects are caused in the fiberglass filaments resulting in reductions in overall mechanical strength. Furthermore, fiberglass which is destined for use as building insulation and sound attenuation is often shipped in a compressed form to lower shipping costs. When the compressed bundles of fiberglass are utilized at the job site, it is imperative that the fiberglass product recover a substantial amount of its precompressed thickness. Otherwise, loss of insulation and sound attenuation properties may result.

Traditionally, fiberglass has been treated with phenol/formaldehyde resole binders to alleviate the previously-mentioned defects. See, e.g. *Phenolic Resins*, A. Knop, et al., Springer-Verlag New York, c. 1985, p. 214–219. The phenol/formaldehyde binders utilized in the past have been the highly alkaline resole type which have the combined advantages of inexpensive manufacture and water solubility. Typically, the binders are applied to the fiberglass from aqueous solution shortly after the fibers have been produced, and cured at elevated temperature in a curing oven. Under the curing conditions, any remaining aqueous solvent is evaporated, and the phenol/formaldehyde resole cures to a thermoset state. The fibers in the resulting fiberglass product are thus partially coated with a thin layer of thermoset resin, which tends to accumulate at the junctions where fibers cross each other. The resulting product therefore not only suffers from less self-abrasion, but also exhibits higher recovery than a fiberglass product not incorporating a binder.

The alkaline phenol/formaldehyde resoles contain a fairly large excess of formaldehyde from the manufacturing process. This excess of formaldehyde has been taken advantage of by adding urea to the phenol/formaldehyde resole, resulting in a urea-extended resole. Urea-extended phenol/formaldehyde binders are more cost-effective than the straight phenol/formaldehyde resins, but exhibit some loss in properties as the urea content increases. Thus, efforts have been made to incorporate other resins which can enhance the properties of the binder.

In addition to the use of urea to extend phenol/formaldehyde resins for use in fiberglass binders, other nitrogen containing substances, such as dicyandiamide and melamine, have been utilized as well. Urea, and to a certain extent other amino group containing extenders, serve the dual function of providing a lower cost resin as well as reducing emissions of formaldehyde. Urea, for example, is available at approximately 20% of the cost of the alkaline phenol/formaldehyde resoles commonly used in fiberglass binders. Thus, an extension of the binder with 30% percent urea provides a substantial cost savings.

Moreover, urea is well known as a scavenger for formaldehyde, and incorporation of urea into the resin mix and allowing it to react in, the product being called a "prereact", is known to lower formaldehyde emissions up to approximately the stoichiometry of the urea/formaldehyde reaction. Although additional urea might further lower formaldehyde emissions, at same time, ammonia emissions and "blue smoke" are dramatically increased as the amount of urea or other nitrogenous substances approach and exceed the formaldehyde stoichiometry. Although efforts in the industry to eliminate or substantially reduce formaldehyde are well known, less well known is the fact that ammonia emissions are also under extreme scrutiny, with several states having exceptionally stringent requirements in this regard. Thus, it is desirable to lower both the formaldehyde and ammonia emissions from fiberglass binder compositions.

Further attempts have been made to reduce formaldehyde and ammonia emissions in addition to use of nitrogenous formaldehyde scavengers. Many such attempts include replacing all or substantial portions of the phenol/formaldehyde resin with other resins which are not formaldehyde-based resins. Examples of such substitutions include U.S. Pat. No. 5,340,868 where the traditional phenol/formaldehyde binders are replaced in whole by a binder containing a polycarboxy polymer, a β-hydroxyalkylamide, and a trifunctional monomeric carboxylic acid. In U.S. Pat. No. 5,318,990 is disclosed a similar composition further employing an alkaline metal salt of a phosphorous-containing organic acid. Resin systems such as the foregoing have not met with commercial success, predominately due to the increased cost of the resins. Epoxy resin-based binders have the same drawbacks in addition to which they are generally not dilutable with water (reducible), and thus must be applied as dispersions.

In U.S. Pat. No. 5,108,798, a binder is proposed which contains a β-hydroxyurethane functional material and a polycarboxylic acid. The binder is suggested for use alone or as a partial replacement for phenol/formaldehyde resins. The binder cost is increased, however, and formaldehyde emissions are only reduced relative to the proportion of phenol/formaldehyde solids replaced. In U.S. application Ser. No. 08/489,903 is disclosed addition of a polycarboxylic acid, which itself is incapable of curing, to a phenol/formaldehyde based binder. The binder displayed synergistically reduced formaldehyde emissions, and ammonia emissions were also reduced. However, polyacrylic acid is still a relatively high cost product, and thus overall binder cost is increased as well. Moreover, the levels of emissions are still in need of improvement.

The reaction sequences leading to formation of binder compositions have also been investigated. For example, in U.S. Pat. No. 4,757,108, a urea-extended phenol/formaldehyde resin was prepared by first reacting urea into a phenol/formaldehyde resole under acidic conditions, followed by neutralization and further addition of urea under alkaline conditions. However, such manipulations of the basic resin formulation are not known to produce other than relatively minor improvements in emissions. Replacement of traditional ammonium sulfate cure catalysts with acidic aluminum sulfate catalysts to reduce formaldehyde and ammonia emissions is disclosed in U.S. application Ser. No. 08/490,034. However, further improvement is needed.

Unless methods may be found to sharply curtail both formaldehyde and ammonia emissions, continued commercial viability of phenol/formaldehyde based binders is questionable. Moreover, wholesale substitution of other resin systems has, thus far, proved to be too costly, or to produce a cured binder with inadequate properties. Unfortunately, the consumer may have to bear these higher costs and lower performance factors in order to reap the environmental benefits of reduced emissions, unless a method of reducing emissions of the commonly used and relatively inexpensive phenol/formaldehyde based binders can be found.

It would be desirable to provide phenol/formaldehyde fiberglass binder compositions which are economical, which can be utilized with existing equipment, which can provide acceptable physical properties in the binder-coated fiberglass product, and which especially can provide these advantageous properties while sharply reducing formaldehyde and/or ammonia emissions.

SUMMARY OF THE INVENTION

It has now been surprisingly discovered that addition of minor quantities of bisulfite to phenol/formaldehyde binders provides significant reductions in formaldehyde emissions during both the forming and curing stages of fiberglass manufacture, and in preferred embodiments, may lower ammonia emissions in the curing oven as well. The binder-coated fiberglass products display excellent physical properties.

DESCRIPTION OF THE PREFERRED EMBODIMENTS

The phenol/formaldehyde resins utilized in the subject binders are preferably prepared conventionally, i.e., under basic conditions using an excess of formaldehyde to produce a water reducible resin containing little unreacted phenol, but a substantial excess of formaldehyde. Other phenol/formaldehyde resins may be utilized as well, for example those produced under acidic conditions or at initially low formaldehyde levels. However, some such resins suffer from problems with respect to water reducibility, and thus traditional, alkaline resole resins are preferred.

To reduce excess formaldehyde in the phenol/formaldehyde resin, traditional amino-group containing formaldehyde scavengers alone or in conjunction with other formaldehyde scavengers such as polyacrylic acid or mixtures of polyacrylic acid or other polycarboxylic acids with a polyol or polyhydroxypolymer such as glycerine, polyglycerol, polyvinylalcohol, and the like, may be used. Although a number of amino-group-containing scavengers, such as guanidine, benzoguanidine, various methylolated compounds such as methylolurea, and the like, may be used, the most common nitrogenous scavengers are melamine, dicyandiamide, and urea, particularly the latter due to its low cost. More than one formaldehyde scavenger may be used, if desired, for example melamine and urea.

The amount of formaldehyde contained in excess in the phenol/formaldehyde resin and the amount of formaldehyde scavenger are interrelated. In general, the formaldehyde content of the resin is adjusted such that from 10 to about 50 parts by weight, preferably 20 parts by weight to 40 parts by weight of urea or other nitrogenous scavenger are used for each 100 parts by weight of total resin solids. The binders created by extension with urea or other scavengers are frequently identified by the ratio of phenol/formaldehyde solids to scavenger solids. For example, one of the most frequently used binders is a 70/30 urea-extended binder containing nominally 70 weight percent phenol/formaldehyde solids and 30 weight percent urea, based on total solids. The solids content of the aqueous binders are generally from 5 to 60 weight percent. Such binders are generally prepared by adding urea or other nitrogenous formaldehyde scavenger to a phenol/formaldehyde alkaline resole resin containing about 10–15% excess formaldehyde. The urea, melamine, or other scavenger is generally added to the phenol/formaldehyde resin from 8 to 24 hours prior to use of the binder solution, where it reacts into the system at ambient temperatures, forming urea/formaldehyde, melamine/formaldehyde, or other resin in situ. The resins thus formed do not, in general, behave similarly to mixtures of the respective resins prepared separately, and thus the resins are believed to equilibrate to complex mixtures containing numerous polymeric species.

The phenol/formaldehyde resins used herein may be prepared at the site of application, for example by the process disclosed in U.S. Pat. No. 5,300,562, herein incorporated by reference, but are also commercially available from a number of sources, e.g., Neste and Borden. The phenol/formaldehyde resins should be aqueous compatible, i.e. water reducible without phase separation to the degree suitable for binder application.

The bisulfite scavenger may be any bisulfite which is water soluble at the concentrations utilized. Suitable bisulfites include the alkali metal bisulfites, particularly sodium bisulfite; ammonium bisulfite; and the alkaline earth metal bisulfites, e.g., calcium bisulfite. Some bisulfites, e.g., sodium bisulfite, are available commercially as aqueous solutions, but are unstable when in dry form. In such cases, a meta-bisulfite or other bisulfite precursor may be used. In the context of the subject application, the term "bisulfite" includes both compounds containing bisulfite ions per se, or precursor compounds which generate bisulfite ions in solution. Surprisingly, sulfites do not appear to provide any substantial benefit with regard to reduced formaldehyde emissions, and may increase ammonia emissions. Under the basic conditions exhibited by most phenol/formaldehyde resole resins, sodium sulfite will remain in the sulfite form in the resin system. However, sodium sulfite may be used in conjunction with an acidifying acid which serves to produce bisulfite ions. Hence, sodium sulfite may be used in conjunction with such an acid provided that bisulfite ion formation occurs to a substantial extent. Under these conditions (acid treatment), sodium sulfite may be considered a bisulfite ion precursor.

The amount of bisulfite ion useful is within the range of 1.0 weight percent to 10 weight percent, preferably 2 weight percent to 8 weight percent, and most preferably about 3 to about 6 weight percent, these weight percents based on total resin solids, and calculated based on the bisulfite ion equivalent amount of ammonium bisulfite. The bisulfite may be added to the phenol/formaldehyde urea prereact in the holding tank, or may be metered into the binder solution just prior to spraying on the glass fibers. Reductions in formaldehyde emissions greater than 50% have been demonstrated with both ammonium bisulfite and sodium bisulfite at concentrations between 3 to 6 weight percent. Surprisingly, spraying of the bisulfite-containing binder solution onto hot fiberglass during fiberglass blanket or mat formation does not appear to generate sulfur oxides under these conditions, nor are appreciable quantities of sulfur oxides generated when the binder coated fiberglass product is oven-cured at elevated temperatures. Thus, addition of bisulfite does not merely substitute one emission source for another, but lowers total emissions.

Bisulfites have been employed in conjunction with certain particular phenol/formaldehyde resins, but not in resins for fiberglass binders nor in resin systems employing amino-group-containing formaldehyde scavengers. For example, U.S. Pat. No. 3,108,990 discloses addition of a number of sulfur compounds to phenol/formaldehyde wood glues to prevent surface scum and to maintain resin viscosity. Sulfur compounds employed include sodium sulfide, hydrogen sulfide, sodium sulfite, sodium bisulfite, and sodium metabisulfite, for example. However, the low formaldehyde content of such resins prevents aqueous reducibility to the levels required for fiberglass binder applications. Moreover, as demonstrated herein, compounds such as sodium sulfite do not provide the benefits achieved by bisulfites.

In U.S. Pat. No. 4,101,489, addition of bisulfite or hydroxymethanesulfonate to a phenol/formaldehyde condensation reaction mixture followed by reaction at elevated temperature produces a polymer containing sulfonate groups which enhance their use as dispersants for disperse dyes. The use of elevated temperatures causes the bisulfite or hydroxymethane-sulfonate to become part of the polymer molecule where it is no longer available for formaldehyde scavenging. In the present invention, the bisulfite, when added to the holding tank at ambient temperatures, may react with formaldehyde to produce addition compounds, but does not react into the resin per se to any substantial extent. Thus, the majority of bisulfite added, even after prolonged standing, is still available as bisulfite.

In U.S. Pat. No. 4,458,049, phenol and formaldehyde are reacted in the presence of an alkali metal bisulfite to produce a water insoluble resin containing polymer-bound sulfite or sulfonate groups. This resin is then combined with a urea/formaldehyde resin and further reacted with melamine, optionally with added bisulfite, again at elevated temperature at which the bisulfite reacts into the polymer. The ionic groups produced by incorporation of bisulfite into the polymer aid in dispersing the water-insoluble polymer in water.

In the present invention, the bisulfite is not given the opportunity to react into the polymer system, becoming a part of the polymer chain and effectively removing bisulfite from the aqueous phase, but is added either by metering into the phenol/formaldehyde, nitrogenous scavenger-containing prereact immediately prior to spraying onto the hot fiberglass being formed into a mat or blanket, or added to the prereact binder composition in the holding tank maintained at ambient temperature, for example between 10° C. and 40° C., preferably about 20°–30° C., the reasonably expected industrial storage temperatures, temperatures at which no substantial reaction of bisulfite into the polymer will occur.

Formaldehyde and sulfites and bisulfites are known to form addition products, however, it is quite surprising that at the temperature of the blanket or mat forming stage, where aqueous binder is sprayed onto hot glass fibers in mid-air, and that during further curing of the binder-coated fibers at elevated temperatures, that the addition products do not break down to liberate formaldehyde and sulfur oxides, e.g., sulfur dioxide. These results indicate that the bisulfite becomes incorporated into the binder during cure, and thus the binder-coated fiberglass product is different from those prepared from phenol/formaldehyde binders not containing a bisulfite formaldehyde scavenger.

Having generally described this invention, a further understanding can be obtained by reference to certain specific examples which are provided herein for purposes of illustration only and are not intended to be limiting unless otherwise specified.

EXAMPLES 1–4 AND COMPARATIVE AND/OR CONTROL EXAMPLES C-1 to C-4

A 70/30 phenol/formaldehyde urea prereact was prepared by adding urea to a phenol/formaldehyde resin identified as 415T15 supplied by Georgia Pacific Resins, Inc., a standard, commercial phenol/formaldehyde resole resin designed for use in 70/30 urea extended binders containing c.a. 46% resins solids and 9–10 weight percent excess formaldehyde, the amount of formaldehyde adjusted by addition during manufacture of a minor amount of urea. Urea was added in a ratio of 70 weight percent resin solids to 30 weight percent urea solids. After the normal prereact time of c.a. 12 hours, the approximately 42 weight percent solids solution was in-line mixed with a solution containing ammonium sulfate cure catalyst and a diaminosilane (OSi A1101), and water. These components were then delivered to six sets ten spray nozzles where they were hydraulically dispersed. The nozzles were arranged in six circles spraying the binders toward the center of hot fiberglass from a distance of about 8 inches. The fiberglass was manufactured using a standard fiberglass spinning machine located about 12 inches above each circle of nozzles. The final solids content of the aqueous binder as sprayed was around 14 weight percent. Fiberglass production and binder spray rates were kept constant such that the final cured binder content represented about 6 weight percent (as determined, e.g., by loss on ignition, LOI) of the finished product, of which 0.2 weight percent represented silane and 3% weight percent represented ammonium sulfate. Various non-nitrogenous formaldehyde scavengers were added as aqueous solutions in-line to the standard binders. The solids added were in addition to normal binder solids, i.e., no substitution. Following binder application, the fibrous mat product was oven-cured for approximately 1.5 to 2 minutes at a temperature of from 450° F. (232° C.) to 500° F. (260° C.) depending upon ambient temperature, humidity, and blanket moisture levels. The product was a low density building insulation.

Emissions testing of samples from the collection stack and oven stack were performed using FTIR and using a flame ionization detector (FID), a standard EPA test for VOCs.

The increase (+) or decrease (–) in formaldehyde emissions of the foregoing Examples and Comparative and Control Examples during fiberglass forming are presented in Table 1, below, with the values representing percent deviation from a control resin not containing non-nitrogenous scavenger. The comparative and control examples were run on the same day and under the same conditions as the operative examples.

TABLE 1

| EXAMPLE[1] | SCAVENGER | % SCAVENGER SOLIDS | % CHANGE IN FORMALDEHYDE EMISSIONS |
|---|---|---|---|
| C-1 | — | — | — |
| C-1A | $Na_2SO_3$ | 6 | +13.0 |
| 1 | $NaHSO_3$ | 6 | –46.0 |
| C-2 | — | — | — |
| 2 | $NaHSO_3$ | 4.5 | –61.2 |
| C-3 | — | — | — |
| 3A | $NaHSO_3$ | 2 | –4.9 |
| 3B | " | 3 | +2.4 |
| 3C | " | 4.5 | –24.4 |
| 3D | " | 6 | –39.0 |
| 3E | $NH_4HSO_3$ | 2 | –31.7 |
| 3F | " | 3 | –39.0 |

TABLE 1-continued

| EXAMPLE[1] | SCAVENGER | % SCAVENGER SOLIDS | % CHANGE IN FORMALDEHYDE EMISSIONS |
|---|---|---|---|
| 3G | " | 4.5 | −43.9 |
| 3H | " | 6 | −51.2 |
| C-4 | — | — | — |
| 4 | $NH_4HSO_3$ | 6 | −56.8 |

[1]Examples beginning with "C" indicate control and/or comparative examples. Examples with similar numbers (e.g., C-1 and 1) were performed on the same day using substantially the same process parameters.

The results from Table 1 indicate that both sodium bisulfite and ammonium bisulfite were highly effective in lowering formaldehyde emissions, ammonium bisulfite particularly so. The results also indicate that sodium sulfite was ineffectual, actually resulting in an increase in formaldehyde emissions during fiberglass forming in addition to which ammonia emissions nearly doubled, while the bisulfite scavengers demonstrated comparable ammonia emissions relative to the controls during forming, and a considerable, dramatic decrease in formaldehyde emissions.

Oven emissions data for the binder solutions are presented in Table 2 in the same manner as for forming emissions. Data for Examples 1 and 2 and C-1, C-1A and C-2 are not presented due to experimental difficulties in achieving reliable data.

TABLE 2

| EXAMPLE | SCAVENGER | % SCAVENGER SOLIDS | % CHANGE IN FORMALDEHYDE EMISSIONS |
|---|---|---|---|
| C-3 | — | — | — |
| 3A | $NaHSO_3$ | 2 | −10.9 |
| 3B | " | 3 | −34.4 |
| 3C | " | 4.5 | −43.8 |
| 3D | " | 6 | −51.6 |
| 3E | $NH_4HSO_3$ | | −59.4 |
| 3F | " | 3 | −57.8 |
| 3G | " | 4.5 | −50.0 |
| 3H | " | 6 | −45.3 |
| C-4 | — | — | — |
| 4 | $NH_4HSO_3$ | 6 | −50.0 |

The data in Table 2 indicates that oven formaldehyde emissions are decreased through the use of bisulfites as well as the decrease presented in Table 1 during forming. In addition to the formaldehyde emissions data presented in Table 2, oven ammonia emissions were decreased by about 14% when using ammonium bisulfite.

EXAMPLES 5 AND COMPARATIVE EXAMPLE C-5

In a manner similar to that described for the previous example, a phenol/formaldehyde resole resin destined for use in a 70/30 urea prereact was formulated to a 65/35 prereact to which was added, in the holding tank, sodium bisulfite in an amount of 6 weight percent based on final binder solids. A control binder was sprayed and cured on fiberglass as before, and the formaldehyde emissions compared. The sodium bisulfite binder resulted in a 51.0 percent decrease in fiberglass forming formaldehyde emissions (−51.0%).

Physical properties of nominal 6 inch (15.2 cm) and 12 inch (30.5 cm) thick batts of fiberglass insulation product prepared with control, comparative, and subject invention binders were measured by standard industry tests. Properties were measured "quick", i.e., shortly after preparation, and also after one week of storage. "Recovery" is the recovered thickness after compression simulating shipping and storage conditions. Higher recovery values are considered desirable. "Droop" is the amount of droop, in inches, established by a batt suspended across two sawhorses or similar supports. Lower values of droop are considered desirable. The results are presented in Table 3 below.

TABLE 3

| | | | "Quick" Physical Properties | | Physical Properties @ 1 wk. | |
|---|---|---|---|---|---|---|
| Binder Of Example | Scavenger % | Scavenger Solids | Recovery, in. (cm) | Droop, in. (cm) | Recovery, in. (cm) | Droop, in. (cm) |
| C-1 | — | — | 10.86 (27.6) | 4.45 (11.3) | 10.37 (26.3) | 5.31 (13.5) |
| C-1A | $Na_2SO_3$ | 6 | 10.85 (27.6) | 4.61 (11.7) | 10.40 (26.4) | 4.92 (12.5) |
| 1 | $NaHSO_3$ | 6 | 10.82 (27.5) | 5.08 (12.9) | 10.15 (25.8) | 5.82 (14.8) |
| C-3 | — | — | 11.15 (28.3) | 3.63 (9.2) | 10.62 (27.0) | 4.17 (10.6) |
| 3A | $NaHSO_3$ | 2 | 11.01 (28.0) | 3.71 (9.4) | 10.80 (27.4) | 3.75 (9.5) |
| 3B | " | 3 | 11.08 (28.1) | 3.65 (9.3) | 11.11 (28.2) | 3.93 (10.0) |
| 3C | " | 4.5 | 11.36 (28.9) | 3.74 (9.5) | 10.80 (27.4) | 4.00 (10.2) |
| 3D | " | 6 | 11.14 (28.3) | 3.80 (9.7) | 10.68 (27.1) | 4.46 (11.3) |
| 3E | $NH_4HSO_3$ | 2 | 11.47 (29.1) | 3.60 (9.1) | 11.05 (28.1) | 4.03 (10.2) |
| 3F | " | 3 | 11.21 (28.5) | 3.66 (9.3) | 10.89 (27.7) | 4.16 (10.6) |
| 3G | " | 4.5 | 11.35 (28.8) | 3.75 (9.5) | 10.92 (27.7) | 3.89 (9.9) |

TABLE 3-continued

| Binder Of Example | Scavenger % | Scavenger Solids | "Quick" Physical Properties Recovery, in. (cm) | "Quick" Physical Properties Droop, in. (cm) | Physical Properties @ 1 wk. Recovery, in. (cm) | Physical Properties @ 1 wk. Droop, in. (cm) |
|---|---|---|---|---|---|---|
| 3H | " | 6 | 11.30 (28.7) | 3.46 (8.8) | 10.83 (27.5) | 3.88 (9.9) |
| C-5 | — | — | 4.71 (12.0) | 3.47 (8.8) | 4.57 (11.6) | 3.33 (8.5) |
| 5 | $NH_4HSO_3$ | 6 | 4.76 (12.1) | 4.18 (10.6) | 4.50 (11.4) | 3.78 (9.6) |

Table 3 indicates that the use of subject binders produced commercially acceptable fiberglass products with no meaningful deterioration of physical properties. On the whole, use of the subject binders appeared to increase physical properties slightly, however this slight overall increase may not be statistically significant.

Having now fully described the invention, it will be apparent to one of ordinary skill in the art that many changes and modifications can be made thereto without departing from the spirit or scope of the invention as set forth herein.

What is claimed is:

1. A method of decreasing formaldehyde emissions during the preparation of binder-coated fiberglass employing an aqueous phenol/formaldehyde-based binder, comprising:

adding to said aqueous phenol/formaldehyde-based binder prior to applying said binder to a fiberglass product, an effective formaldehyde reducing amount of a water-soluble bisulfite formaldehyde scavenger.

2. The method of claim 1 wherein said aqueous phenol/formaldehyde-based binder is a prereact binder prepared by adding to an aqueous phenol/formaldehyde resin, one or more nitrogenous formaldehyde scavengers.

3. The method of claim 2 wherein said one or more nitrogenous formaldehyde scavengers are selected from the group consisting of urea, melamine, and dicyandiamide.

4. The method of claim 3 wherein said nitrogenous formaldehyde scavenger is present in an amount of from about 10 weight percent to about 50 weight percent, said weight percent based on total binder solids exclusive of said bisulfite formaldehyde scavenger.

5. The method of claim 1 wherein said bisulfite formaldehyde scavenger is present in an amount of from about 1.0 weight percent to about 10 weight percent based on total resin solids exclusive of said bisulfite formaldehyde scavenger.

6. The method of claim 2 wherein said bisulfite formaldehyde scavenger is present in an amount of from about 1.0 weight percent to about 10 weight percent based on total resin solids exclusive of said bisulfite formaldehyde scavenger.

7. The method of claim 3 wherein said bisulfite formaldehyde scavenger is present in an amount of from about 1.0 weight percent to about 10 weight percent based on total resin solids exclusive of said bisulfite formaldehyde scavenger.

8. The method of claim 4 wherein said bisulfite formaldehyde scavenger is present in an amount of from about 1.0 weight percent to about 10 weight percent based on total resin solids exclusive of said bisulfite formaldehyde scavenger.

9. The method of claim 5 wherein said bisulfite formaldehyde scavenger is selected from the group consisting of sodium bisulfite, ammonium bisulfite, and mixtures thereof.

10. The method of claim 8 wherein said bisulfite formaldehyde scavenger is selected from the group consisting of sodium bisulfite, ammonium bisulfite, and mixtures thereof.

11. An aqueous phenol/formaldehyde binder suitable for the manufacture of binder-coated fiberglass products, said binder comprising:

a) a prereact prepared by adding to an aqueous compatible phenol/formaldehyde resin containing excess, unreacted formaldehyde, from about 10 to about 50 weight percent of one or more nitrogenous formaldehyde scavengers for a time sufficient to cause said nitrogenous formaldehyde scavenger to substantially react with said excess, unreacted formaldehyde;

b) an effective, formaldehyde reducing amount of one or more water-soluble bisulfite formaldehyde scavengers;

wherein said weight percent of nitrogenous formaldehyde scavenger is based on total solids exclusive of said bisulfite formaldehyde scavenger.

12. The binder of claim 11 wherein said nitrogenous formaldehyde scavenger is selected from the group consisting of urea, melamine, dicyandiamide, and mixtures thereof.

13. The binder of claim 11 wherein said bisulfite formaldehyde scavenger is selected from the group consisting of sodium bisulfite, ammonium bisulfite, and mixtures thereof.

14. The binder of claim 12 wherein said bisulfite formaldehyde scavenger is selected from the group consisting of sodium bisulfite, ammonium bisulfite, and mixtures thereof.

15. The binder of claim 13 wherein said bisulfite formaldehyde scavenger is present in an amount of from about 1.0 to about 10 weight percent based on the weight of solids contained in said prereact.

16. The binder of claim 13 wherein said bisulfite formaldehyde scavenger is present in an amount of from about 3 to about 6 weight percent based on the weight of solids contained in said prereact.

17. The binder of claim 11 wherein said bisulfite formaldehyde scavenger (b) is added to said prereact (a) in a holding tank.

18. The binder of claim 11 wherein said bisulfite formaldehyde scavenger (b) is added to said prereact (a) in-line just prior to spraying onto fiberglass.

19. An aqueous phenol/formaldehyde-based binder suitable for applying to fiberglass to form a binder-coated fiberglass product as claimed in claim 1, said binder comprising:

a) a phenol/formaldehyde resin containing excess, unreacted formaldehyde, the amount of said phenol/formaldehyde resin sufficient to provide from about 60 weight percent to about 80 weight percent phenol/formaldehyde solids based on total resin solids;

b) from about 40 weight percent to about 20 weight percent urea based on total resin solids;

c) from about 2 to about 8 percent of a bisulfite formaldehyde scavenger selected from the group consisting of sodium bisulfite, ammonium bisulfite, and mixtures thereof.

20. A binder-coated fiberglass product prepared by spraying the binder of claim 11 onto freshly formed glass fibers and curing said binder at elevated temperature.

* * * * *